United States Patent [19]

Kadle

[11] Patent Number: 4,831,844

[45] Date of Patent: May 23, 1989

[54] CONDENSER WITH IMPROVED FLOW PATH

[75] Inventor: Durgaprasad S. Kadle, Getzville, N.Y.

[73] Assignee: General Motors Corporation, Detroit, Mich.

[21] Appl. No.: 198,881

[22] Filed: May 26, 1988

[51] Int. Cl.[4] ..... F25B 39/04

[52] U.S. Cl. ..... 62/507; 165/110; 165/150; 165/151; 165/174

[58] Field of Search ..... 62/506, 507; 29/157.3 A, 157.3 B; 165/146, 110, 150, 151, 174

[56] References Cited

U.S. PATENT DOCUMENTS

| | | | |
|---|---|---|---|
| 485,315 | 11/1892 | Yaryan | 165/146 |
| 633,003 | 9/1899 | Hoff | 165/174 |
| 2,068,955 | 1/1937 | Kritzer et al. | 165/150 |
| 2,487,484 | 11/1949 | Simpelaar | 165/174 X |
| 2,785,540 | 3/1957 | Biehn | 62/507 X |
| 2,984,089 | 5/1961 | Whitesel | 62/507 X |
| 3,606,762 | 9/1971 | Anglin et al. | 62/507 X |
| 4,738,225 | 4/1988 | Juang | 165/151 X |

*Primary Examiner*—William E. Tapolcai
*Attorney, Agent, or Firm*—R. L. Phillips

[57] ABSTRACT

A condenser for an air conditioning system has a tube and fin design. The tubular flow path divides into two parallel paths at the condenser inlet. The two paths combine at a junction at a point about two thirds of the distance to the outlet. A single path connects the junction to the outlet. In general condensation of the refrigerant occurs in the dual path and liquid flows at high velocity in the single path to the outlet for better heat transfer and reduced liquid volume in the tubular path.

5 Claims, 1 Drawing Sheet

CONDENSER WITH IMPROVED FLOW PATH

FIELD OF THE INVENTION

This invention relates to a condenser and particularly to a condenser having a flow path for improved heat exchange efficiency.

BACKGROUND OF THE INVENTION

Tube and fin condensers are well known for use in air conditioning and other refrigeration systems. In such condensers a flow path is arranged in a compact serpentine pattern comprising many straight tube sections in a parallel array held near their ends in apertures of header plates and connected by U-shaped bends to form a single passage. It is also well known to use two tubular passages in the array to provide two parallel flow paths. In either case the passage or passages extend from an inlet at one end of the array to an outlet at the other end and the tubes are fitted with fins on their outer surfaces to enhance their heat exchange properties. In use, a refrigerant such as Freon (TM) is introduced under pressure through the inlet as a super heated gas and loses heat to cooler air outside the tubes. The refrigerant gradually condenses as it cools so that it passes through much of the condenser as a two phase mixture and then assumes a liquid state as it approaches the outlet. Cooling of the refrigerant in the liquid state continues until it is discharged.

Improved designs for such heat exchangers are always sought in order to improve the heat exchange efficiency. A higher efficiency allows a condenser for a given heat exchange capacity to be made smaller, lighter and less expensive. Such advantages are particularly welcome in automotive air conditioner systems. Alternatively, a condenser of the same size has a higher heat exchange capacity which results in a lower outlet compressor pressure to yield longer compressor life and lower air conditioner discharge temperature.

SUMMARY OF THE INVENTION

It is therefore an object of the invention to provide a condenser configuration having an improved tube routing for greater heat exchange efficiency than previously available condensers. It is a further object to provide such a condenser for refrigeration systems providing lower pressure drop and better heat transfer efficiency than prior condensers of the same size, volumetric capacity and resistance to air flow.

The invention is carried out by a condenser for a refrigeration system having means for carrying refrigerant through a serpentine circuit comprising; an inlet port and an outlet port, a plurality of heat exchange tubes coupled to the inlet port and routed through a serpentine path, a single heat exchange tube coupled to the outlet port and routed through a serpentine path, and a junction intermediate the inlet and outlet ports for coupling the plurality of tubes to the single tube, whereby refrigerant flows part way from the inlet port to the outlet port in plural paths and flows the remainder of the way to the outlet port in one path.

BRIEF DESCRIPTION OF THE DRAWINGS

The above and other advantages of the invention will become more apparent from the following description taken in conjunction with the accompanying drawings wherein like refrences refer to like parts and wherein.

DESCRIPTION OF THE PREFERRED EMBODIMENT

The description is directed to a condenser for an automotive air conditioning system but it will be seen that the invention is equally useful in other condenser applications.

Figure 1:
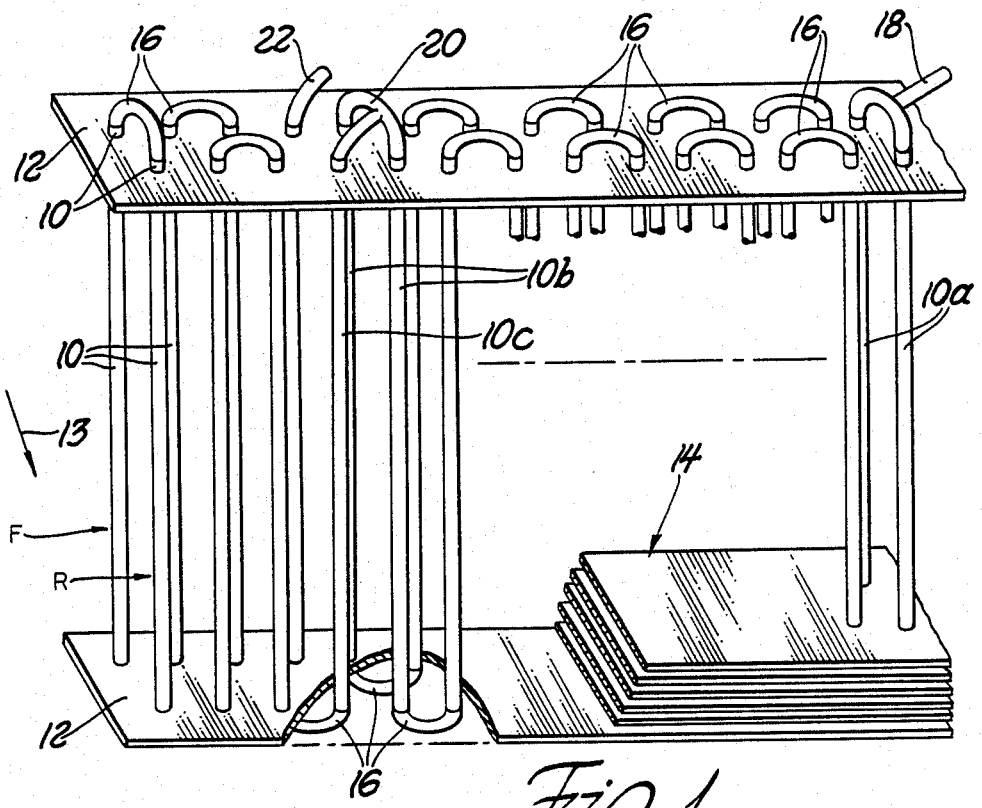
FIG. 1 is a partly broken away isometric view of a condenser according to the invention.

Referring to FIG. 1, a tube and fin condenser for an air conditioner comprises a plurality of parallel straight tubes 10 held near their ends by a pair of spaced apertured header plates 12. The tubes are aligned in two rows, a front row F facing in the direction of incoming air flow (shown by arrow 13) and the rear row R facing in the opposite direction. The tubes extend through a stack of spaced thin plates or fins 14 and are in good thermal contact with the fins 14. The spaced fins define air flow passages for heat transfer from the condenser to the surrounding air. The ends of the tubes 10 which protrude through the header plates 12 are coupled to U-shaped connectors 16 which define the flow path or tube routing according to the pattern of interconnection. In common practice the material for all these parts is aluminum or sometimes copper and the tubes are all interconnected by brazing or soldering to assure pressure tight tube connections. The fins are brazed or mechanically joined to the tubes to provide excellent thermal conductivity from the tubes to the fins. As thus far described in this paragraph, the condenser structure is well known and the method of manufacture of such devices is also known. Indeed, the straight tube array and header plate assembly are unchanged in the improved condenser, the routing changes being accomplish by the tube interconnecting bends.

An inlet port 18 is attached to a T-shaped (or Y-shaped) connector 19 and the connector 19 is coupled to the first tube **10*a* in each row to establish two parallel flow paths. The next few connectors 16 join each tube 10 to an adjacent tube in the same row so that one flow path is in the front row and the second flow path is in the rear row. In a conventional condenser this pattern extends to the outlet at the opposite side of the condenser where the outlet port is connected in the same manner as the inlet port 18. According to the invention, however, the two paths extend about two thirds of the distance across the condenser where they are joined by a curved T-shaped connector 20 which has two branches connected respectively to front and rear row tubes 10*b* and a branched connected to a downstream rear row tube 10*c*, thereby forming a single path which continues to the outlet port 22. The connectors 16 downstream of the junction are positioned to form the path in the rear row to the end of the condenser and then along the front row to the outlet 22 which is positioned between the two sides of the condenser adjacent the T-shaped connector 20. In this manner a single path is connected between the outlet port 22 and the junction with the dual path which, in turn, is connected to the inlet port 18** to enable a continuous flow of refrigerant.

Figure 2:
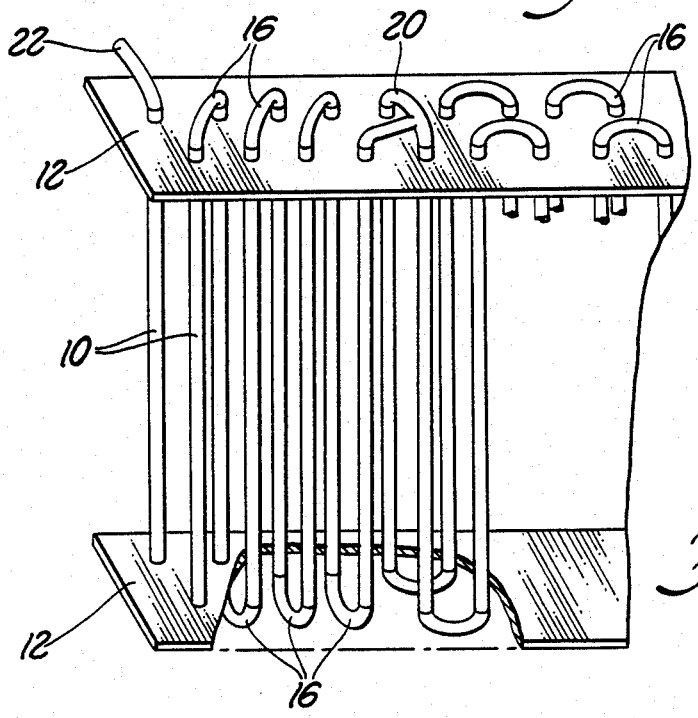
FIG. 2 is a partly broken away isometric view of a condenser according to another embodiment of the invention.

FIG. 2 is the same as FIG. 1 except that due to the placement of the connectors 16 the single path downstream of the junction alternates between the front and rear rows, and the outlet port 22 is attached to the tube 10 farthest from the inlet port. The two embodiments are equivalent in operation and efficiency. When mounted in a system, one embodiment may be easier or less expensive to connect into the system, depending on the system design. For example, the usual orientation of the condensers is with the left side (as shown in the drawings) at the bottom and both inlet and outlet ports being connected to the system at points near the top. In that case the FIG. 1 design would require a shorter extension to connect the outlet 22 to the system since the outlet port 22 would be nearer the top.

In a typical operation of a condenser made according to FIG. 1, a refrigerant such as Freon-12 (TM) is admitted to the condenser through the inlet port 18 at a high pressure, e.g. 250 psig and a temperature of about 200 degrees F. Air flow through the fins 14 carries away heat until the gas condenses to a liquid at a temperature of 155 degrees. As the liquid flows to the outlet port 22 it cools further and exits at about 130 degrees F. and at a pressure of 235 psig. The condensation occurs gradually as the refrigerant flows through the dual path so that a two phase mixture is present in much of the dual path region. The junction with the signal path occurs, as a matter of design, approximately at the place where the refrigerant becomes wholly liquid under standard operating conditions. In a small condenser this point occurs at two thirds of the distance from the inlet 18, but for larger condensers the point moves closer to the half way point. During operation under nonstandard conditions the liquid state will actually occur either upstream or downstream of the junction.

The result of essentially confining the liquid coolant to the single path has several beneficial facets. The liquid is forced to flow at a higher velocity (relative to the conventional dual path condenser) for more efficient heat transfer. Perhaps more importantly, for a given liquid throughput, the fast moving liquid occupies less volume or fewer tubes 10 than in the conventional system so that a greater volume remains for the condensation process which is the more effective thermal transfer mechanism. These comparisons are for condensers having the same air pressure drop. In tests the improved configuration (FIG. 1) had a 10% better efficiency in terms of BTU/min. heat removal rate than the conventional unit. This allows a lower input pressure and a lower compressor outlet pressure which extends compressor life and also yields lower air conditioner discharge temperatures.

It will thus be seen that the improved tube routing or circuit configuration for a condenser provides better heat transfer and a lower pressure drop than a conventional condenser of the same size and requires the same or less material for its use in an air conditioning system.

The embodiments of the invention in which an exclusive property or privilege is claimed are defined as follows:

1. A condenser for a refrigeration system having means for carrying refrigerant through a serpentine circuit comprising;

an inlet port and an outlet port, a plurality of heat exchange tubes coupled to the inlet port and routed through a serpentine path, a single heat exchange tube coupled to the outlet port and routed through a serpentine path, and a junction intermediate the inlet and outlet ports for coupling the plurality of tubes to the single tube, whereby refrigerant flows part way from the inlet port to the outlet port in plural paths and flows the remainder of the way to the outlet port in one path.

2. The invention as defined in claim 1 wherein the plurality of heat exchange tubes comprise two tubes.

3. A condenser for a refrigeration system having means for carrying refrigerant through a serpentine circuit comprising;

an inlet port and an outlet port, a pair of heat exchange tubes coupled to the inlet port and routed through a serpentine path, a single heat exchange tube coupled to the outlet port and routed through a serpentine path, each serpentine path being comprised of straight tube sections joined by U-shaped bends, and a junction intermediate the inlet and outlet ports for coupling the pair of tubes to the single tube, whereby refrigerant flows part way from the inlet port to the outlet port in two paths and flows the remainder of the way to the outlet port in one path.

4. The invention as defined in claim 3 wherein the junction comprises a lateral branch coupled to a U-shaped bend for connecting the pair of tubes to the single tube.

5. A condenser for a refrigeration system having means for carrying refrigerant through a serpentine circuit comprising;

an inlet port for admitting hot refrigerant gas to the condenser and an outlet port for discharging liquid refrigerant, a plurality of heat exchange tubes coupled to the inlet port and routed through a serpentine path for cooling the gas until it condenses to liquid state, a single heat exchange tube coupled to the outlet port and routed through a serpentine path for cooling the liquid, and a junction intermediate the inlet and outlet ports for coupling the plurality of tubes to the single tube at the approximate point that the refrigerant becomes wholly liquid, whereby refrigerant flows from the inlet port as a gas and as a two phase mixture primarily in plural paths and flows in liquid phase to the outlet port primarily in one path.

* * * * *